US007669671B2

(12) United States Patent
Hall et al.

(10) Patent No.: US 7,669,671 B2
(45) Date of Patent: Mar. 2, 2010

(54) SEGMENTED SLEEVE ON A DOWNHOLE TOOL STRING COMPONENT

(76) Inventors: David R. Hall, 2185 S. Larsen Pkwy., Provo, UT (US) 84606; Paula Turner, 2185 S. Larsen Pkwy., Provo, UT (US) 84606; Nathan Nelson, 2185 S. Larsen Pkwy., Provo, UT (US) 84606

( * ) Notice: Subject to any disclaimer, the term of this patent is extended or adjusted under 35 U.S.C. 154(b) by 224 days.

(21) Appl. No.: 11/841,101

(22) Filed: Aug. 20, 2007

(65) Prior Publication Data

US 2008/0230218 A1 Sep. 25, 2008

Related U.S. Application Data

(63) Continuation-in-part of application No. 11/688,952, filed on Mar. 21, 2007, now Pat. No. 7,497,254.

(51) Int. Cl.
*E21B 17/02* (2006.01)

(52) U.S. Cl. ..... 175/74; 175/320; 166/242.6

(58) Field of Classification Search ..... 175/40, 175/74, 320; 166/65.1, 237, 242.6
See application file for complete search history.

(56) References Cited

U.S. PATENT DOCUMENTS

| | | | | |
|---|---|---|---|---|
| 1,817,772 | A | 8/1931 | Sipe | |
| 1,846,539 | A * | 2/1932 | Baurmann | 285/302 |
| 1,977,175 | A | 10/1934 | Davis | |
| 2,066,473 | A | 1/1937 | Jorgensen | |
| 2,325,811 | A | 8/1943 | Terrell | |
| 2,354,887 | A | 8/1944 | Silverman | |
| 2,664,272 | A | 12/1953 | Boice | |
| 2,676,820 | A | 4/1954 | Boice | |
| 2,999,552 | A | 9/1961 | Fox | |
| 3,079,549 | A | 2/1963 | Martin | |
| 3,085,939 | A | 4/1963 | Fitch | |
| 3,125,173 | A | 3/1964 | Fox | |
| 3,146,611 | A | 9/1964 | Fox | |
| 3,175,374 | A | 3/1965 | Toelke | |
| 3,186,222 | A | 6/1965 | Martin | |
| 3,194,331 | A | 7/1965 | Arnold | |
| 3,338,069 | A | 8/1967 | Ortloff | |
| 3,360,960 | A | 1/1968 | Massey | |
| 3,554,397 | A | 1/1971 | Yount | |
| 3,606,402 | A | 9/1971 | Medney | |
| 3,773,359 | A | 11/1973 | Chance | |
| 3,793,632 | A | 2/1974 | Still | |
| 3,876,972 | A | 4/1975 | Garrett | |
| 3,903,974 | A | 9/1975 | Cullen | |
| 3,968,473 | A | 7/1976 | Patton | |
| 4,204,707 | A | 5/1980 | Lincicome | |
| 4,215,426 | A | 7/1980 | Klatt | |

(Continued)

*Primary Examiner*—William P Neuder
(74) *Attorney, Agent, or Firm*—Tyson J. Wilde; Philip W. Townsend, III

(57) ABSTRACT

In one aspect of the invention a downhole tool string component has a segmented sleeve slideably attached over the exterior of a mandrel which is adapted for connection to an adjacent tool string component. An end of the sleeve is abutted against a shoulder element of the mandrel and an opposite end of the sleeve is axially loaded by a threaded element attached to the mandrel. The sleeve comprises at least one sleeve segment with an engagement end comprising at least one axial anti-rotation assembly adapted to transfer torque to an adjacent sleeve segment, the shoulder element, or the threaded element.

20 Claims, 13 Drawing Sheets

U.S. PATENT DOCUMENTS

| | | | | |
|---|---|---|---|---|
| 4,328,704 | A | | 5/1982 | Arpasi |
| 4,365,678 | A | | 12/1982 | Fitch |
| 4,460,202 | A | | 7/1984 | Chance |
| 4,479,564 | A | | 10/1984 | Tanguy |
| 4,683,944 | A | | 8/1987 | Curlett |
| 4,722,402 | A | | 2/1988 | Weldon |
| 4,785,247 | A | | 11/1988 | Meador |
| 4,811,597 | A | | 3/1989 | Hebel |
| 4,811,800 | A | | 3/1989 | Hill |
| 4,892,337 | A | | 1/1990 | Gunderson |
| 5,039,137 | A | | 8/1991 | Cankovic |
| 5,040,620 | A | | 8/1991 | Nunley |
| 5,040,622 | A | | 8/1991 | Winship |
| 5,248,857 | A | | 9/1993 | Ollivier |
| 5,334,801 | A | | 8/1994 | Mohn |
| 5,691,712 | A | | 11/1997 | Meek |
| 5,950,744 | A | * | 9/1999 | Hughes ..... 175/320 |
| 5,988,276 | A | | 11/1999 | Oneal |
| 6,012,744 | A | | 1/2000 | Wilson |
| 6,026,897 | A | | 2/2000 | Pringle |
| 6,655,452 | B2 | | 12/2003 | Zillinger |
| 6,851,489 | B2 | | 2/2005 | Hinds |
| 6,896,049 | B2 | | 5/2005 | Moyes |
| 7,267,185 | B2 | * | 9/2007 | Underwood et al. ..... 175/325.2 |
| 7,493,960 | B2 | * | 2/2009 | Leising et al. ..... 166/380 |
| 2002/0139582 | A1 | * | 10/2002 | Caraway et al. ..... 175/53 |
| 2003/0070842 | A1 | | 4/2003 | Bailey |
| 2004/0184871 | A1 | | 9/2004 | Luft |
| 2005/0155770 | A1 | * | 7/2005 | Parrott ..... 166/380 |
| 2007/0272444 | A1 | * | 11/2007 | Carlson et al. ..... 175/320 |

* cited by examiner

SEGMENTED SLEEVE ON A DOWNHOLE TOOL STRING COMPONENT

CROSS REFERENCE TO RELATED APPLICATIONS

This application is a continuation-in-part of U.S. patent application Ser. No. 11/688,952 filed on Mar. 21, 2007 now U.S. Pat No. 7,497,254 and entitled Pocket for a Downhole Tool String Component. The abovementioned reference is herein incorporated by reference for all that it discloses.

BACKGROUND OF THE INVENTION

The invention relates to a downhole tool string, more specifically to a component of a downhole tool string. Many connections of the various components making up a tool string require transferring torque between the various components. For example, when a section of tubing is attached to a well completion tool, matching threads are formed on the tool and the tubing, or to a sub attached to the tubing, so that the connection can be made by advancing and rotating one of the components relative to the other.

U.S. Pat. No. 5,156,206 by Cox et al., which is herein incorporated by reference for all that it contains, discloses a connector for connecting tubing to a component in a downhole well completion system in which a sub is provided for connection to the component and a sleeve extends over a portion of the sub to define a mandrel for receiving the tubing. A plurality of locking spaces extend in windows provided through the sub and are forced into locking engagements with the reeled tubing as the sleeve is advanced over the sub to transfer axial and torsional loads from the component to the tubing.

U.S. Pat. No. 4,712,813 by Passerell et al., which is herein incorporated by reference for all that it contains, discloses a stab-type coupling apparatus adapted to receive an associated pipe end in a body thereof and prevent its withdrawal there from. A retaining ring retained between the body and stiffener has a radially inward extending toothed portion that grippingly engages the external surface of the associated pipe end.

U.S. Pat. No. 4,407,526 by Cicenas et al., which is herein incorporated by reference for all that it contains, discloses a stab-type coupling and method for connecting an end portion of a smooth wall pipe. The coupling is defined by a non-metallic coupling body, a generally elongated hollow insert, an annular retaining spacer ring, seal rings, a collet back-up ring, and retaining collet all disposed within the recess of the coupling body.

BRIEF SUMMARY OF THE INVENTION

In one aspect of the invention a downhole tool string component has a segmented sleeve slideably attached over the exterior of a mandrel which is adapted for connection to an adjacent tool string component. An end of the sleeve is abutted against a shoulder element of the mandrel and an opposite end of the sleeve is axially loaded by a threaded element attached to the mandrel. The sleeve comprises at least one sleeve segment with an engagement end comprising at least one axial anti-rotation assembly 270 adapted to transfer torque to an adjacent sleeve segment, the shoulder element, or the threaded element.

The sleeve may comprise exteriorally disposed pins that may attach to windows on the outer surface of the mandrel. The mandrel may be a drill pipe, a housing around the drill pipe, or a combination thereof. The mandrel may also comprise a shoulder element that is threadedly disposed onto the mandrel. The sleeve disposed on the mandrel may comprise sensitive electronic components such as a Lacoste gravimeter, an absolute gravimeter, a superconducting gravimeter, gyros, computer chips, memory, electronic filters, AD/DA converters, power sources, buffers, sensors, drilling instrumentation, processors, or a combination thereof. The electronic components may be disposed within blades on the exterior of the sleeve. The sleeve may be in communication with a power source that may activate the electronic components. The anti-rotation assembly 270 may comprise a plurality of teeth with spaces between the teeth forming a castle cut geometry, a wave geometry, a jagged geometry, or a combination thereof. The teeth of the anti-rotation assembly 270 may be formed on the outer surface of the sleeve. The teeth may also be spaced equal to the width of the individual teeth. The thickness of the teeth may be equal to the thickness of the sleeve wall and able to withstand 20,000 ft/lbs of torque. The space intermediate the teeth may comprise a depth equal to the height of the teeth for which the spaces engage. The teeth may also comprise rounded corners. It is believed that with rounded corners when torque is applied it less likely that cracks will results and the sleeve will last longer.

The wave geometry may comprise teeth with sides angled outward from the axis of the space intermediate the teeth. The wave geometry 500 may also comprise teeth with rounded corners relative to teeth on a castle cut geometry or jagged geometry.

The anti-rotation device may also comprise jagged teeth. The peak of each tooth in a jagged geometry may be offset to one side. It is believed that a castle cut geometry, a wave geometry, a jagged geometry, or a combination thereof may lessen the chance of cracks created by torque on the sleeve.

The anti-rotation assembly 270 may also comprise pegs that engage holes within an opposing segment. The pegs may comprise a diameter equal to the thickness of the sleeve. Generally the ends comprise radial teeth comprising the thickness of the sleeve. In other embodiments the anti-rotation assembly 270 may comprise a single engaging tooth and a single space to receive the tooth.

The sleeve may comprise a cylindrical seal extending from the bore of one segment to the bore of another segment. The seal may be an o-ring disposed in the interior of the sleeve that comprises a groove and an elastomeric ring disposed in the groove. It is believed that an o-ring may provide a tight seal preventing leakage or entry of debris. The seal may also comprise a smaller diameter than the diameter of the segment into which it may engage.

DETAILED DESCRIPTION OF THE INVENTION AND THE PREFERRED EMBODIMENT

Figure 1:
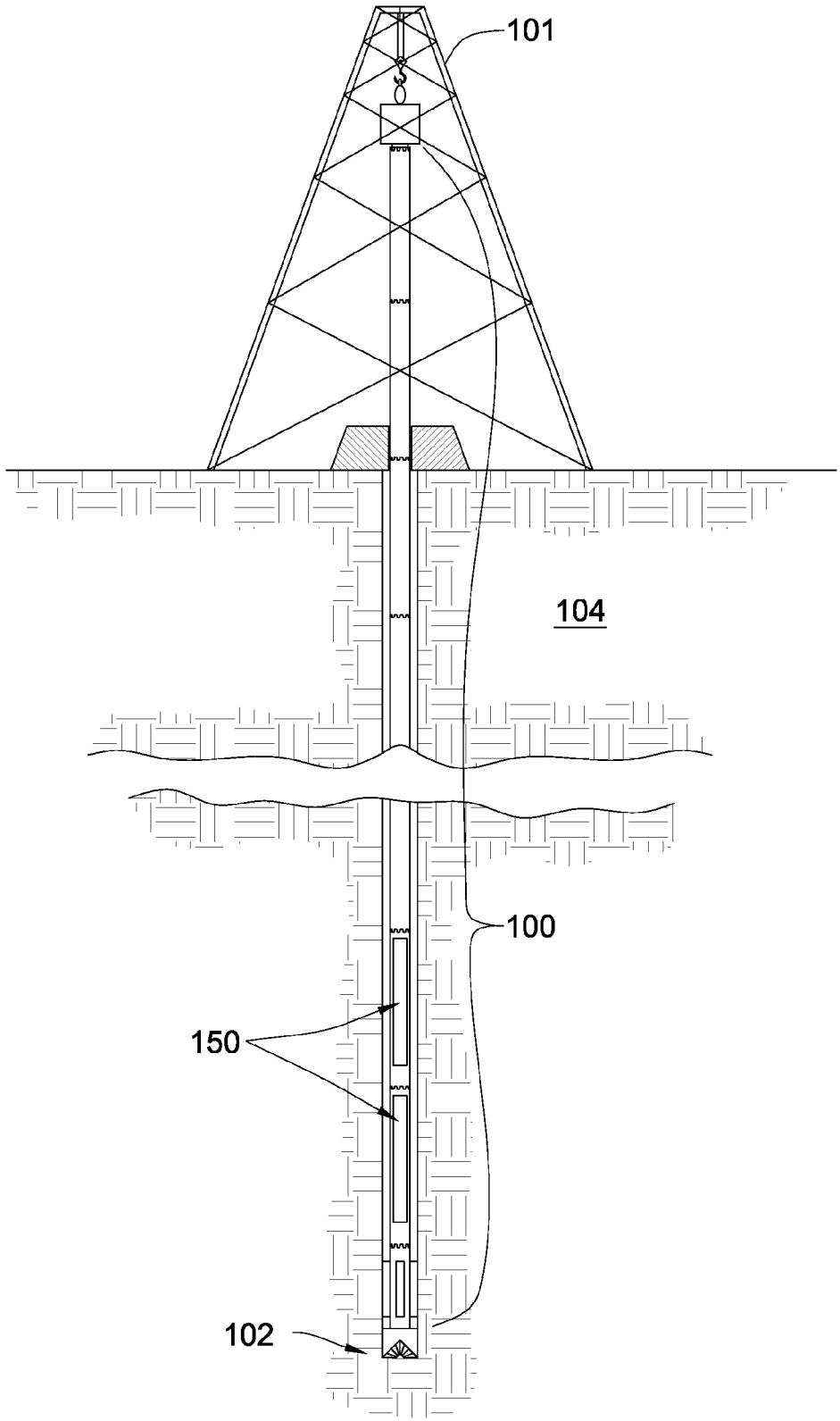
FIG. 1 is an orthogonal diagram of an embodiment of a derrick and a tool string.

FIG. 1 is an orthogonal diagram of a derrick 101 attached to a tool string 100 comprising a drill bit 102 located at the bottom of a bore hole. The tool string 100 may be made of rigid drill pipe, drill collars, heavy weight pipe, jars, and/or subs. As the drill bit 102 rotates downhole the tool string 100 advances farther into the formation 104 due to the weight on the drill bit 102 and a cutting action of the drill bit 102. The sleeve 103 may comprise blades 150 disposed on the outer surface of the tool string.

Figure 2:
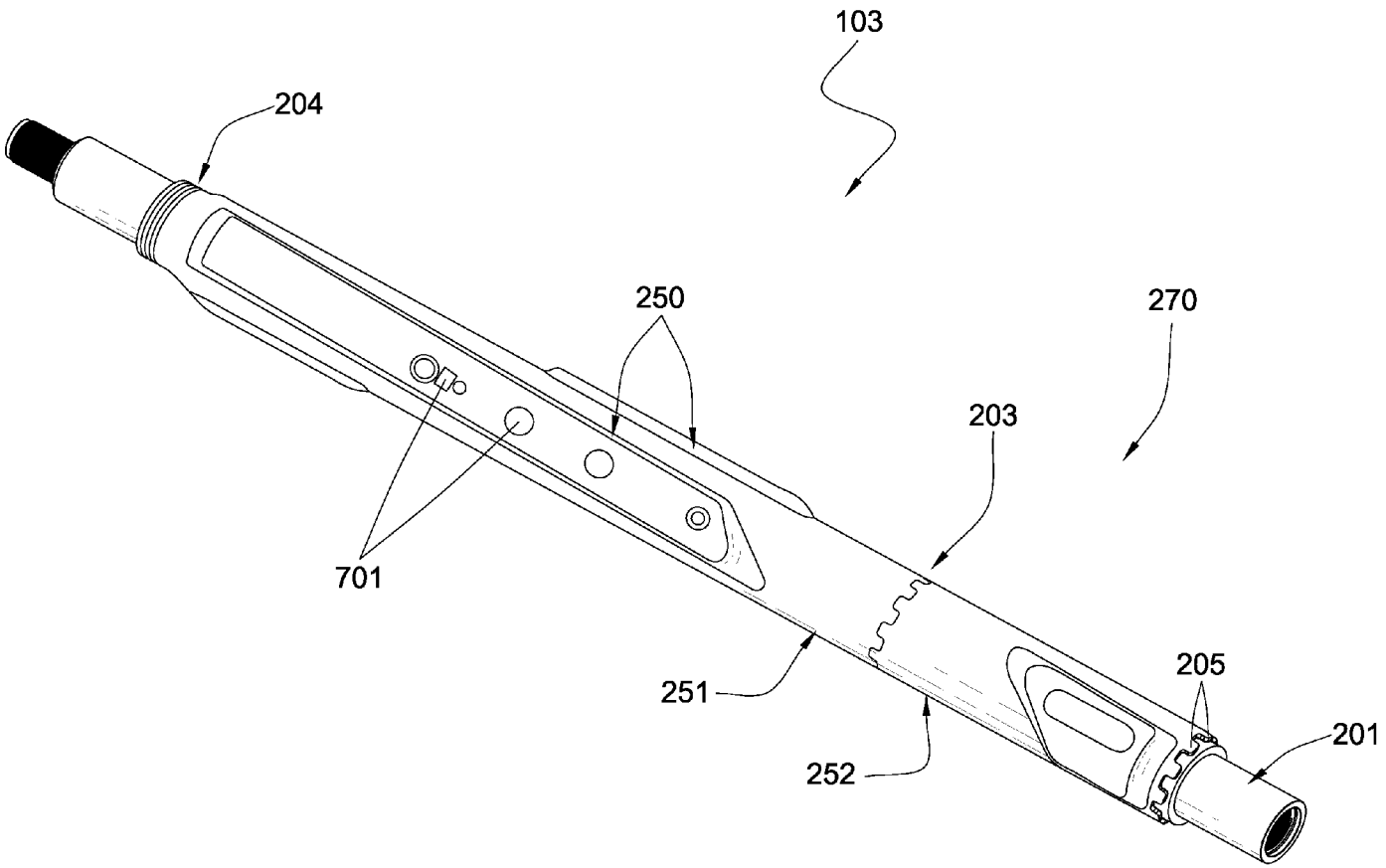
FIG. 2 is a perspective diagram of an embodiment of a sleeve disposed over a mandrel.

FIG. 2 is a perspective diagram of a sleeve 103 attached to a mandrel 201. FIG. 2 shows a sleeve 103 comprising an anti-rotation assembly 270 with a castle cut geometry 203. The anti-rotation assembly 270 may also comprise a jagged geometry, a wave geometry, pegs, or a combination thereof. The mandrel 201 may be a drill pipe positioned coaxially within the sleeve 103. The mandrel 201 may comprise threads 204 on each end of the sleeve 203 adapted to receive a shoulder that may axially load segment 251 and segment 252 of the sleeve 103. The sleeve 103 may comprise a cylindrical geometry and each segment of the sleeve 103 may comprise a castle cut geometry 203 with teeth 205 adapted to engage one another. In some embodiments, there may be electronic components disposed within pockets formed on an inner diameter of the sleeve. An anti-rotation assembly may aid in keeping the sleeve segments rotating with respect to each other thereby preventing some of the electronic components from twisting that may result from the drilling process. In some embodiments the electronic components may be disposed within a blade 250 of the sleeve 103. The blades 250 disposed on the outer surface of the sleeve 103 may also stabilize the tool string as it proceeds downhole.

Figure 3:
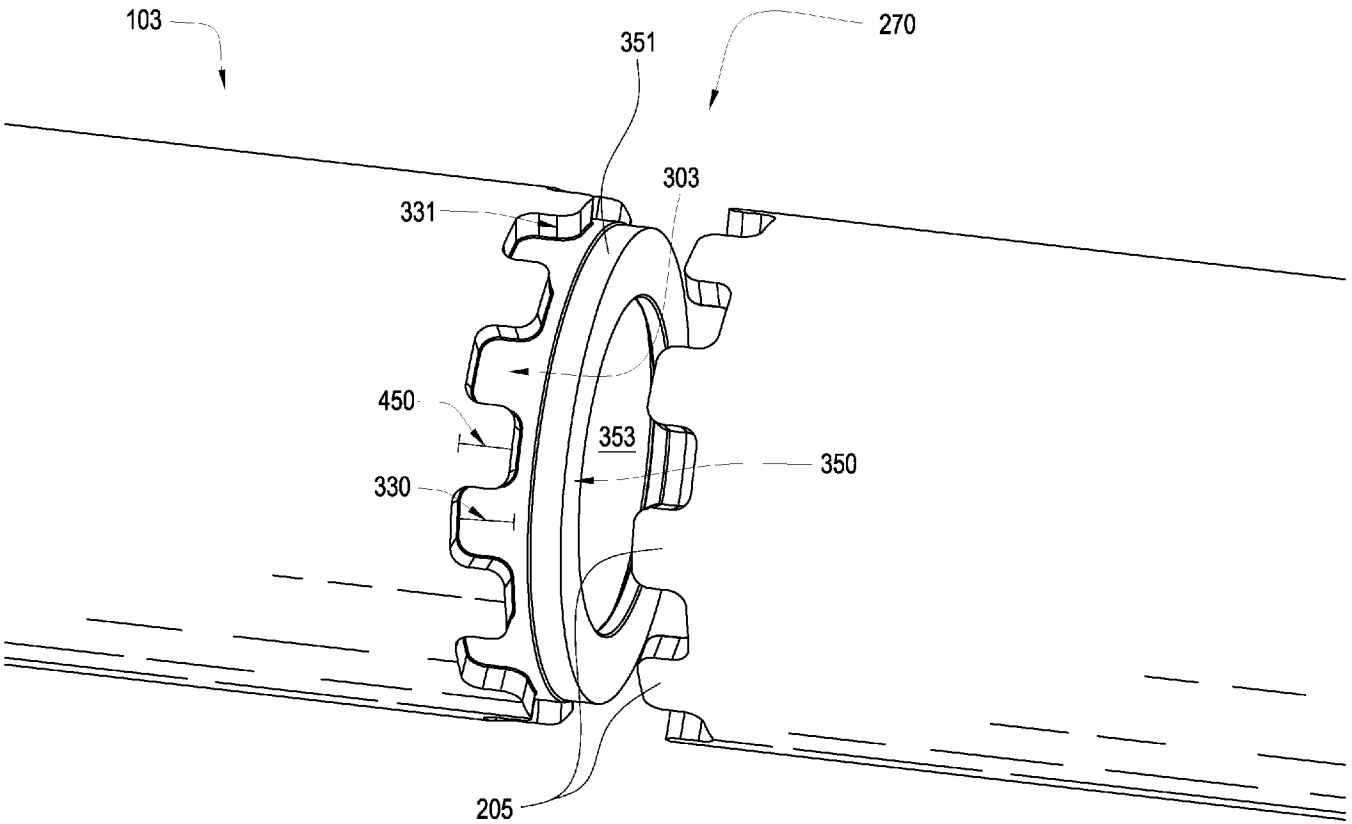
FIG. 3 is a perspective diagram of an embodiment of a sleeve.

FIG. 3 is a perspective diagram of a sleeve 103. The sleeve 103 may comprise an anti-rotation assembly 270 on the ends of the segments. The anti-rotation assembly 270 may comprise a plurality of teeth 205 on both ends of the segments extending towards each other. The anti-rotation assembly may comprise spaces 303 between the teeth which are adapted to receive the teeth 205 of the other segment. The anti-rotation assembly 270 may also comprise a single tooth 205 and single receiving space 303. The teeth 205 may comprise a height 450, equal to the depth 330 of the spaces 303. The teeth 205 may comprise a thickness equal to the thickness of the sleeve wall 331. To protect the electronic components from downhole drilling forces the anti-rotation assembly 270 may be able to withstand 20,000 ft/lbs of torque. The sleeve 103 may comprise a cylindrical seal assembly 350 with a bore 353 disposed around the mandrel and may be intermediate the mandrel and the sleeve segments. The seal assembly 350 may comprise an o-ring disposed within a groove 351. The seal assembly may be adapted to prevent fluid communication between the sleeve segments. In some embodiments, one of the sleeves may comprise hydrophones and may be in fluid communication with the drilling mud while the other sleeve segment comprises electronic equipment requiring a dry environment. In some embodiments, the seal assembly will prevent fluid from leaking through the union of the ends of the sleeve segments to the electronic equipment.

Figure 4:
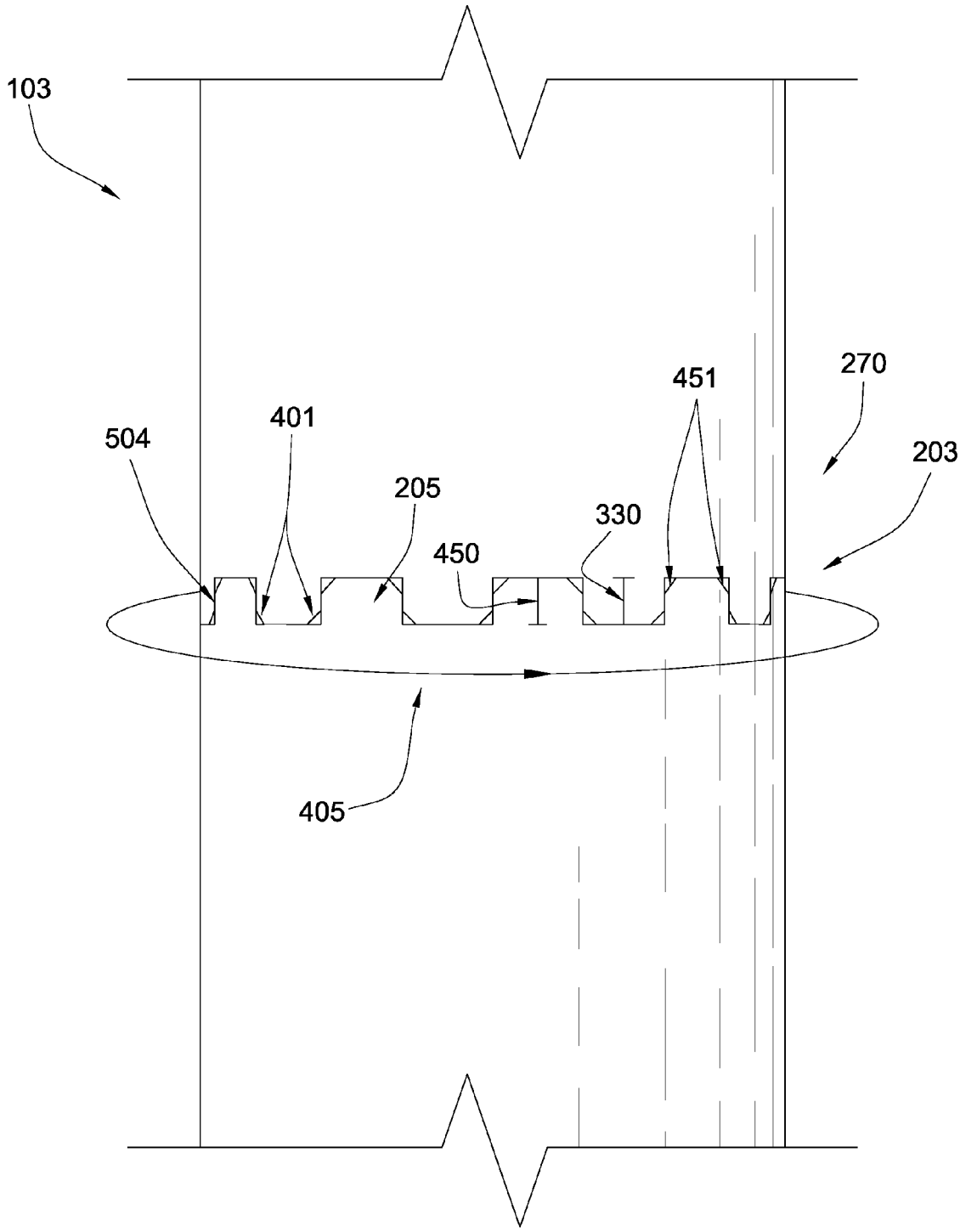
FIG. 4 is a perspective diagram of an embodiment of an anti-rotation assembly.

FIG. 4 is a perspective diagram of a sleeve 103 comprising an anti-rotation assembly 270 with a castle cut geometry 203. FIG. 4 shows the sleeve 103 rotating in the direction of the arrow 405. The corners 401 of the radial teeth 205 may be rounded or slanted and may create a pocket 451 when engaged to an adjacent segment of the sleeve 103. It is believed that by having rounded corners stress risers in the sleeve 103 will be reduced. The sides 504 of the teeth in a castle cut geometry 203 may be substantially parallel to the axis of the teeth 205.

Figure 5:
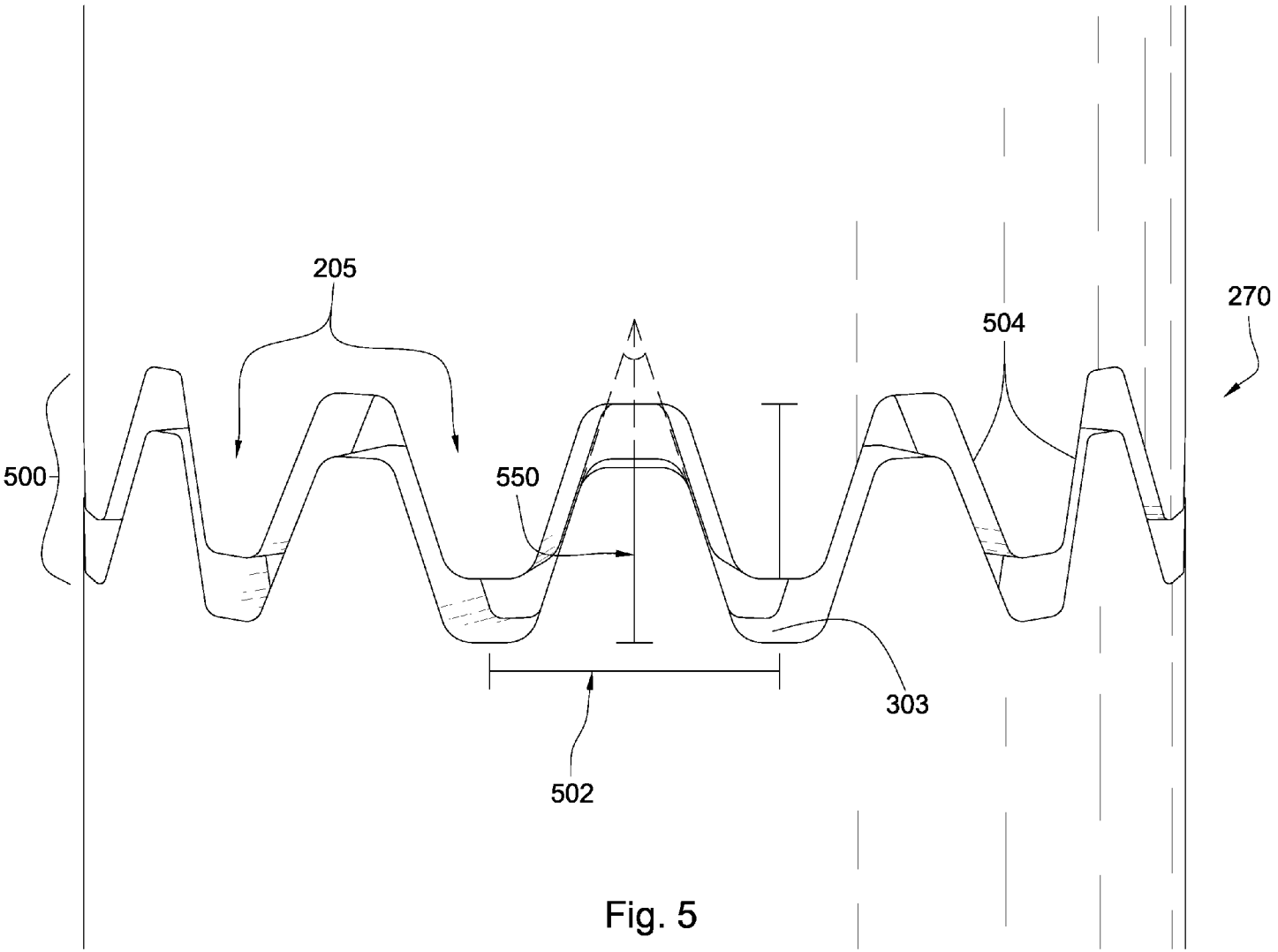
FIG. 5 is a perspective diagram of another embodiment of an anti-rotation assembly.

FIG. 5 is a perspective diagram of an anti-rotation assembly 270 comprising a wave geometry 500. The anti-rotation assembly may extend around the sleeve 103. The wave geometry 500 may comprise teeth 205 with sides 504 angled outward from the axis 550 of the tooth. The spaces 303 intermediate the teeth 205 may match the outline of the engaging teeth 205 on an adjacent segment. The distance 502 of each tooth from one another may be equal around the sleeve 203.

Figure 6:
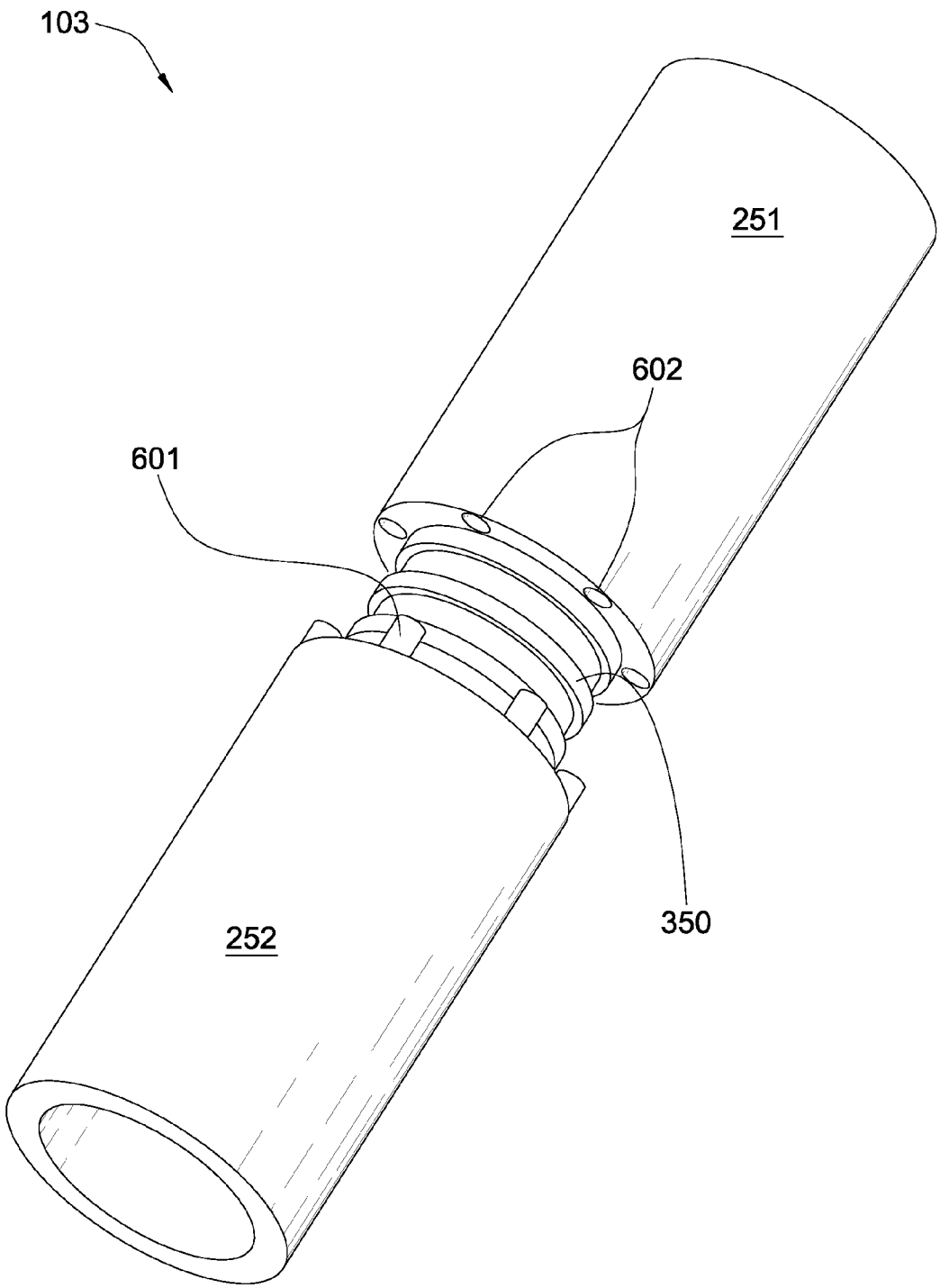
FIG. 6 is a perspective diagram of another embodiment of an anti-rotation assembly.

FIG. 6 is a perspective diagram of an anti-rotation assembly 270 comprising pegs 601. Segment 252 may comprise a plurality of pegs 601 that may engage segment 251. Segment 251 may comprise holes 602 to receive the pegs 601 from segment 252. The pegs 601 on segment 252 may be large enough in diameter to create a press fit with the pegs holes 602 on segment 251. The pegs 601 may comprise a diameter equal to the thickness of the sleeve wall and may extend to one inch in length. The pegs 601 may extend at an angle relative to the sleeve 103 or in a direction straight such as shown in FIG. 6. The pegs 601 may be spaced equal to one another around sleeve 103. The holes 602 may also be evenly spaced around the sleeve 103. A sleeve comprising pegs 601 may provide an easy engagement and provide a proper connection between segment 251 and segment 252. The pegs for teeth may contain electrical connections for electronics.

Figure 7:
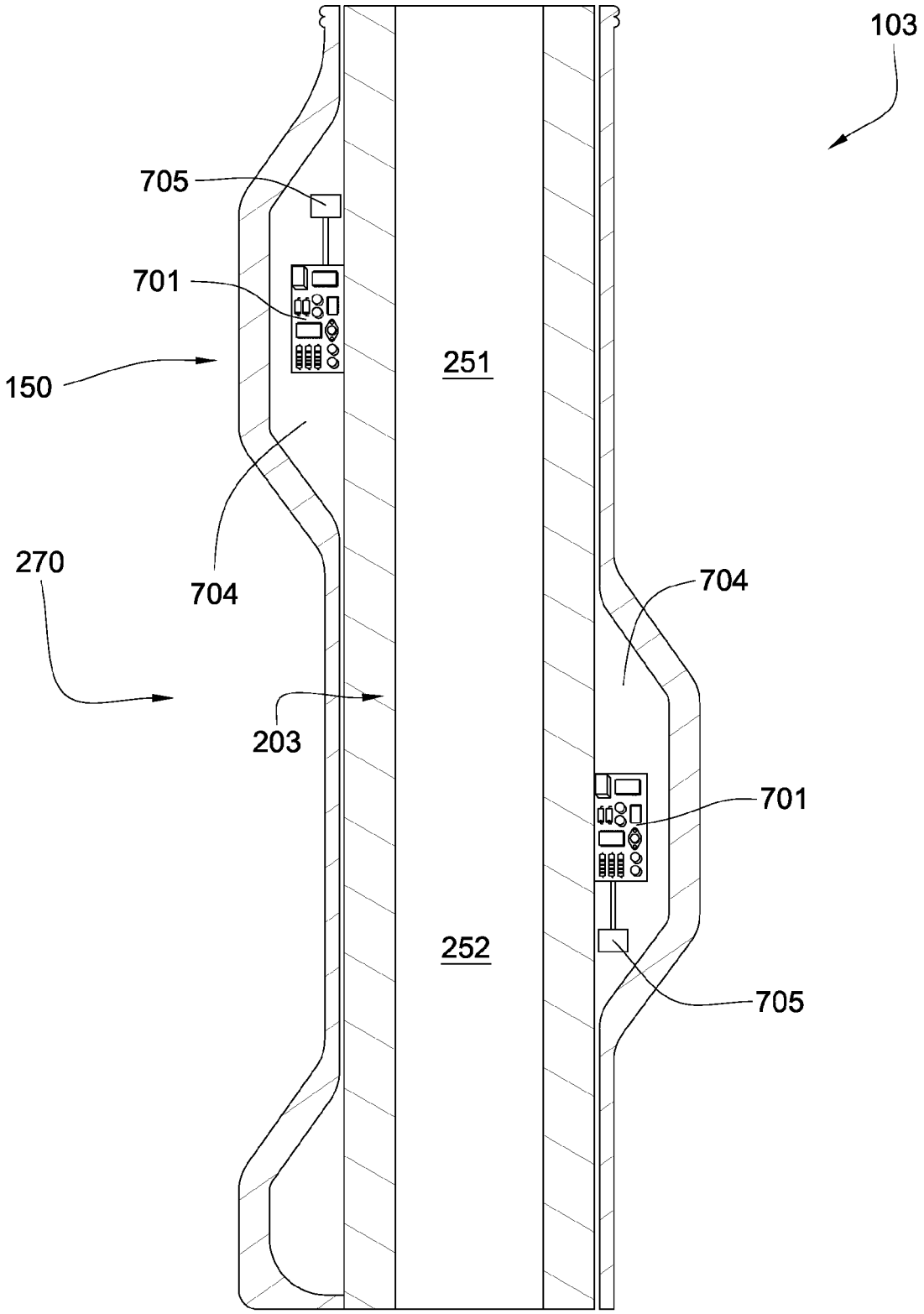
FIG. 7 is a cross-sectional diagram of an embodiment of a sleeve comprising electronic components.

FIG. 7 is a cross-sectional diagram of a sleeve 103 comprising blades 150 with pockets 704. Electronic components 701 may be disposed within the pockets 704. The electronic components 701 may include a Lacoste gravimeter, an absolute gravimeter, a superconducting gravimeter, gyros, computer chips, memory, electronic filters, AD/DA converters, power sources, buffers, sensors, drilling instrumentation, processors, or a combination thereof. The electronic components 701 may be in communication with a power source 705. The power source may be a battery, a turbine, or a combination thereof. FIG. 7 shows segment 251 and segment 252 comprising an anti-rotation assembly 270 with castle cut geometry 203 and engaging one another.

Figure 8:
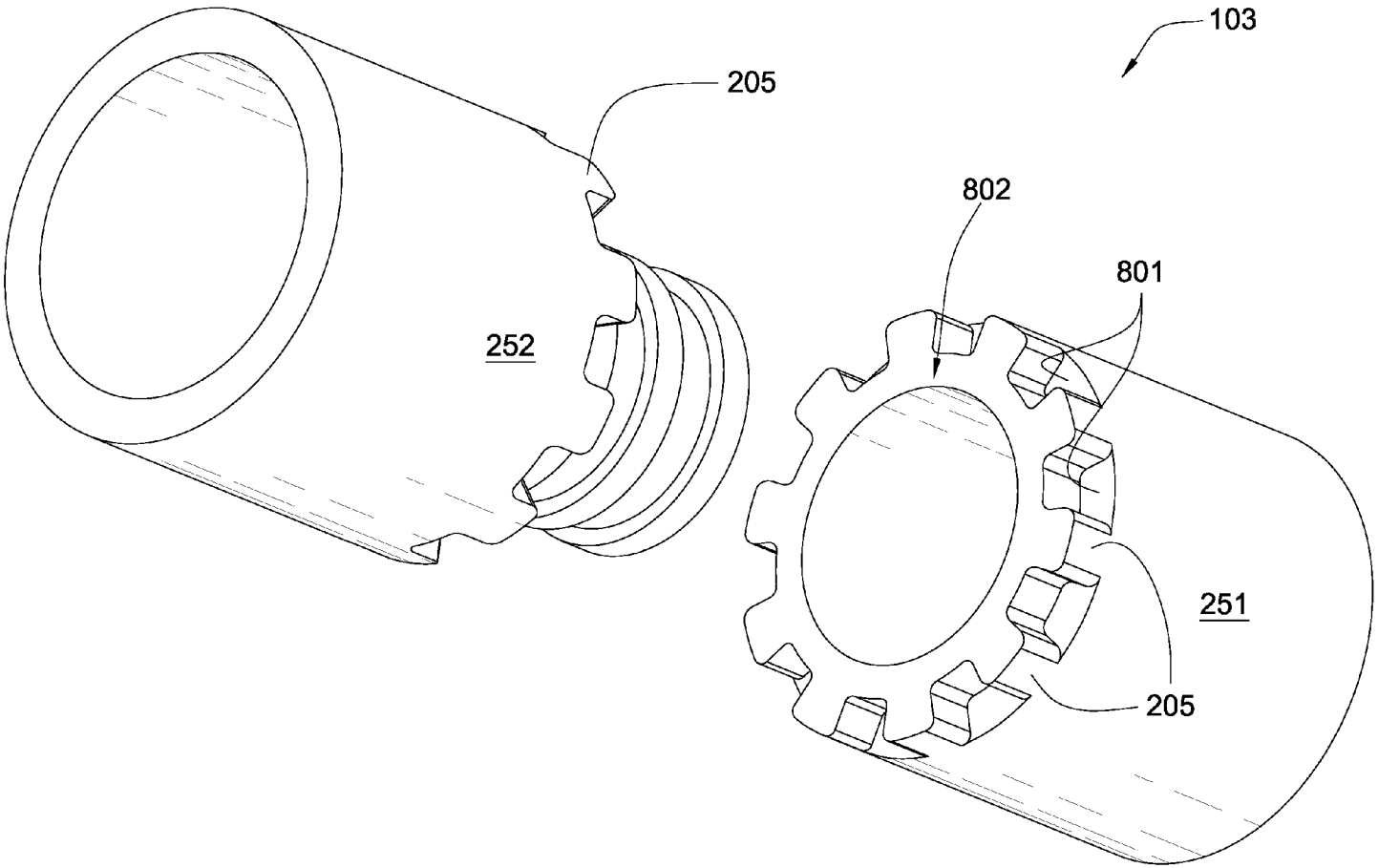
FIG. 8 is a perspective diagram of another embodiment of an anti-rotation assembly.

FIG. 8 is a perspective diagram of another embodiment of an anti-rotation assembly. Segment 251 of the sleeve 103 may comprise teeth 205 in a sprocket geometry 802 radially formed around the sleeve 103. The sleeve 103 may also comprise indents 801 as shown in FIG. 8. The indents 801 may comprise a depth equal to the height of the teeth 205 adapted to engage the indents 801. Segment 252 may comprise teeth 205 extending axially from the sleeve and adapted to interlock with the indents 801.

Figure 9:
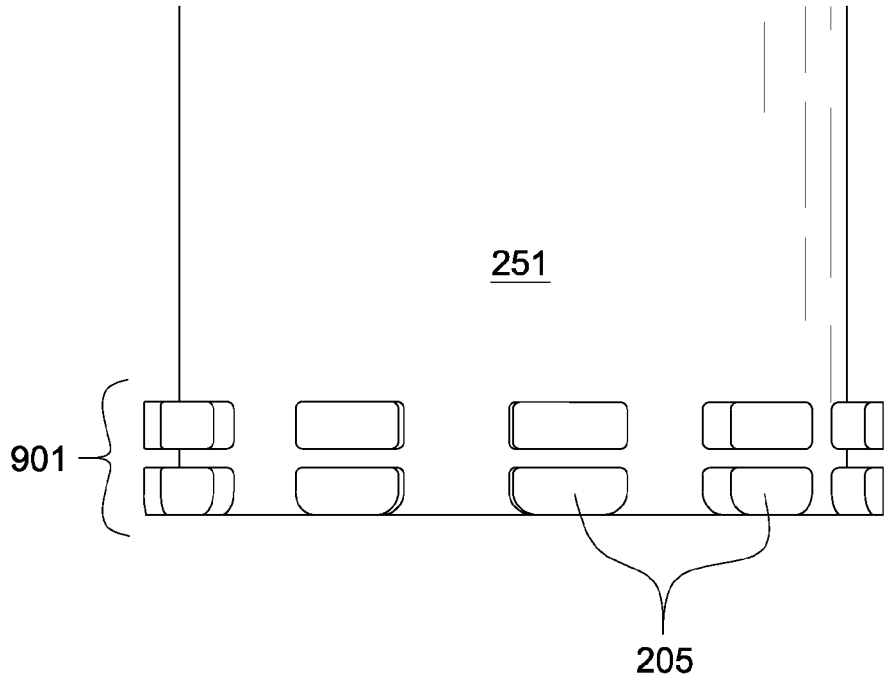
FIG. 9 is an orthogonal diagram of another embodiment of an anti-rotation assembly.
Figure 9:
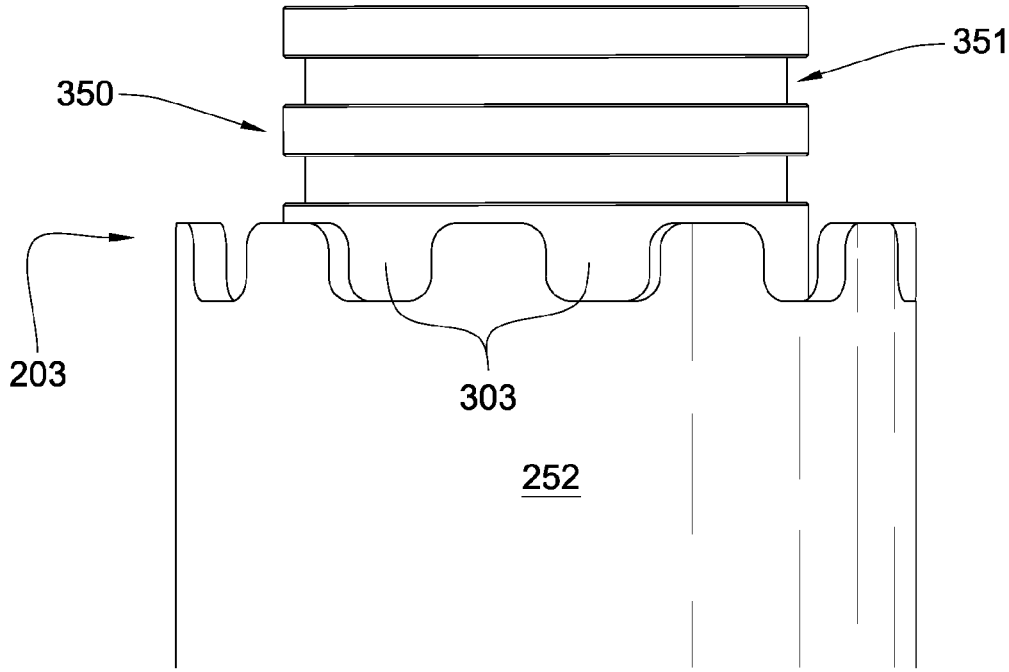

Referring now to FIG. 9 the sleeve may comprise a segment 251 with teeth 205 that extend outward from the outer surface of the sleeve 103 in a plurality of rows 901. Segment 252 of the sleeve 103 may comprise a castle cut geometry 203 adapted to receive the teeth 205 disposed in a plurality of rows 901. The plurality of rows 901 of teeth 205 may add structural support to the portions of the sleeve 103 where the most torsional force may be applied. The rows 901 of teeth may be disposed on segment 251 of the sleeve 103 and engage intermediate spaces 303 between the teeth of a segment 252. Segment 252 may comprise an inner seal 350 adapted to fit within the bore of a segment 251. The outer diameter of the seal 350 may be slightly smaller than the inner diameter of the sleeve 103. The seal 350 may comprise an inner diameter larger than the outer diameter of the mandrel.

Figure 10:
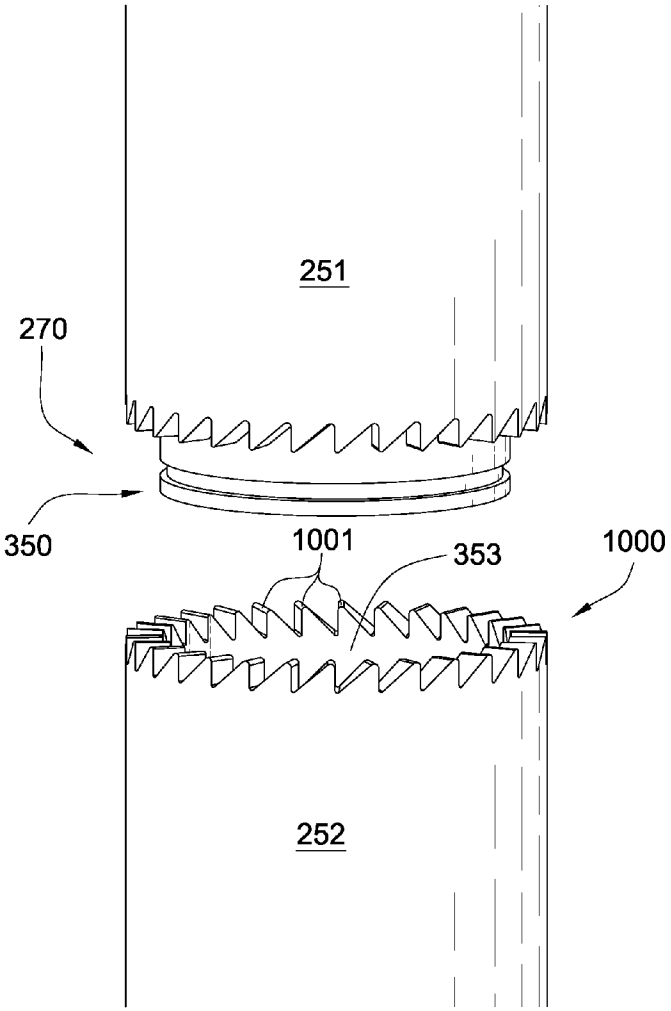
FIG. 10 is an orthogonal diagram of another embodiment of an anti-rotation assembly.

FIG. 10 is an orthogonal diagram of another embodiment of an anti-rotation assembly 270. The anti-rotation assembly 270 may comprise teeth 205 in a jagged geometry 1000. The teeth 205 may comprise peaks 1001 that may be offset. The jagged geometry may comprise teeth with rounded peaks 1001. The teeth 205 may comprise a height equal to the depth of the spaces intermediate the teeth 205.

Figure 11:
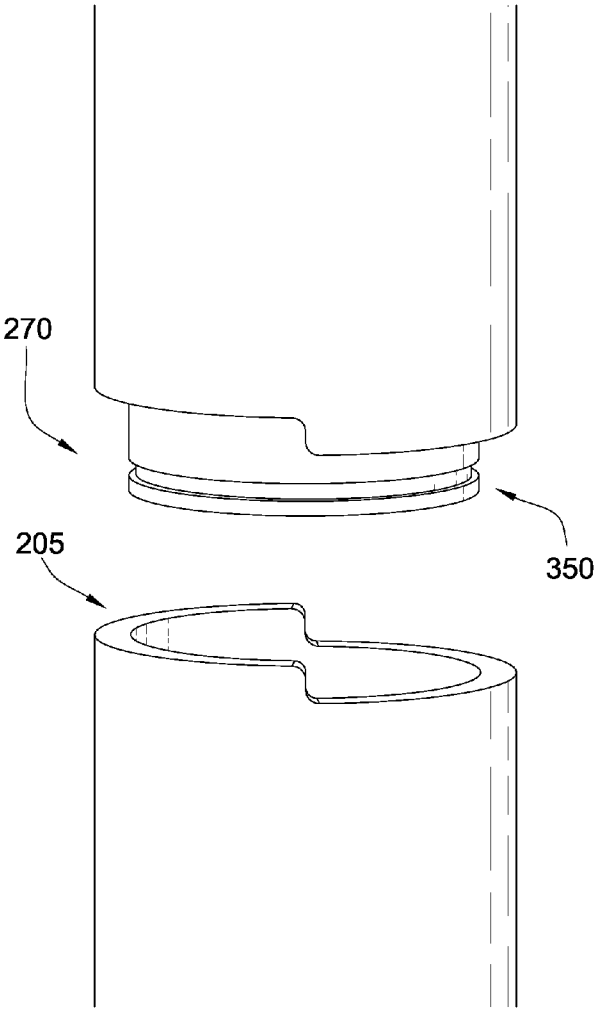
FIG. 11 is an orthogonal diagram of another embodiment of an anti-rotation assembly.

The anti-rotation assembly 270 may also comprise a single tooth 205 and single receiving space 303, such as shown in FIG. 11.

Figure 12:
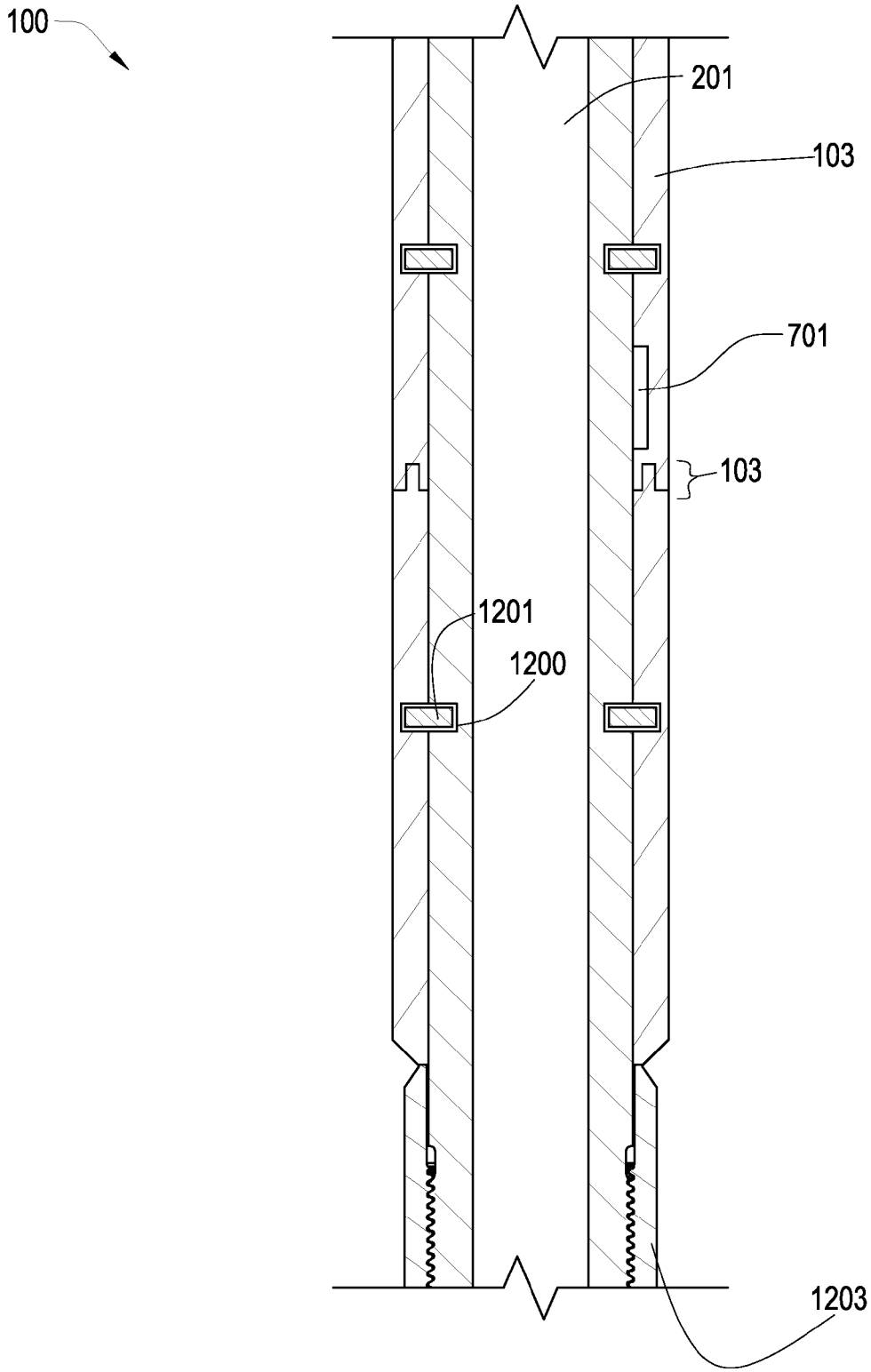
FIG. 12 is a cross-sectional diagram of an embodiment of a tool string.

FIG. 12 is a cross-sectional diagram of a portion of a tool string 100. The sleeve 103 may comprise multiple segments with an anti-rotation assembly 270. The segments of the sleeve 103 may abutt against a shoulder element 1203 that is threadedly attached to the mandrel 201. Threading the shoulder 1203 element onto the mandrel 201 may axially load the sleeve 103. The mandrel 201 may also comprise grooves 1200 adapted to receive pins 1201. The pins 1201 may be disposed on the inner diameter of the sleeve 103 and adapted to fit within the grooves 1200 of the mandrel 201. Electronics components 701 may be disposed within the sleeve 103.

Figure 13:
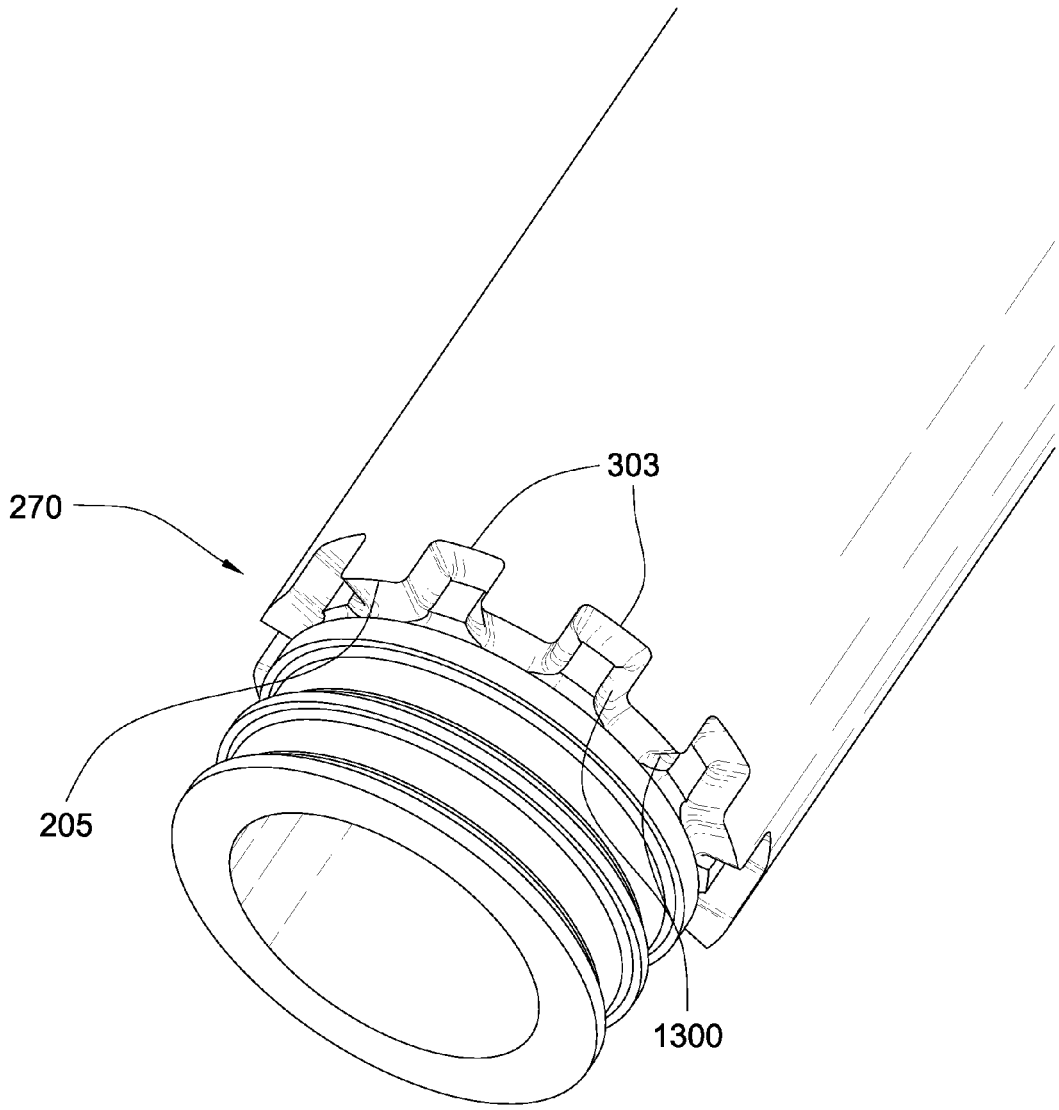
FIG. 13 is a perspective view of an embodiment of an anti-rotation assembly.

FIG. 13 is a perspective view of an embodiment of an anti-rotation assembly 270. The anti-rotation assembly 270 may comprise a stress release groove 1300 on the spaces 303 intermediate the teeth 205. The stress release groove 1300 may aid in the manufacturing process of the anti-rotation assembly 270. The stress release groove 1300 may also aid in preventing stress risers.

Figure 14:
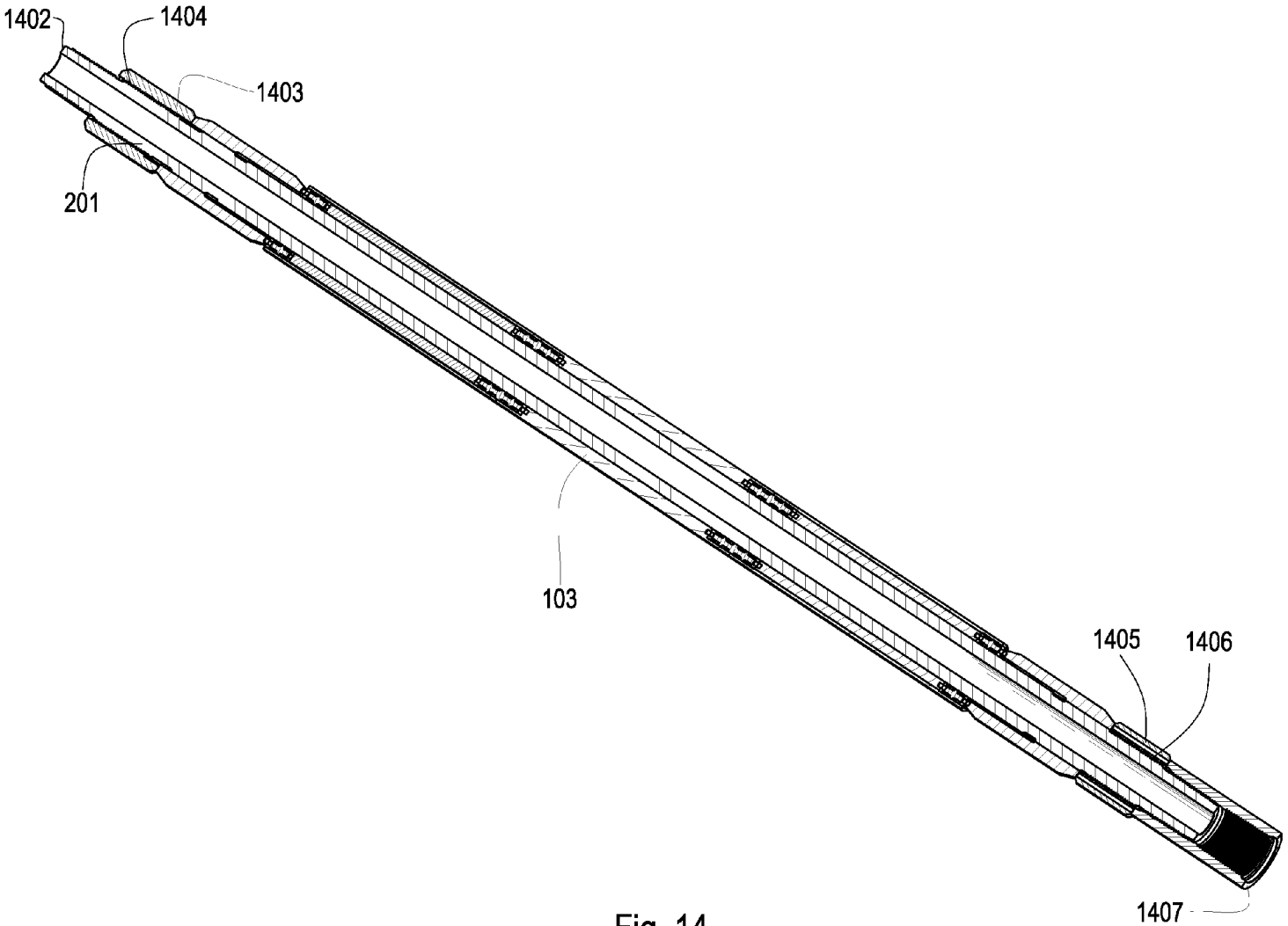
FIG. 14 is a perspective cross-sectional diagram of an embodiment of a sleeve disposed over a mandrel.

FIG. 14 is a perspective cross-sectional view of an embodiment of a sleeve disposed over a mandrel. A first left-threaded collar 1403, may be disposed around the first end 1402 on a left threaded portion 1404 of the mandrel 201. A second left-threaded collar 1405 may also be threaded onto a left-threaded portion 1406 at the second end 1407 of the component. The first left-threaded collar 1403 may act as a shoulder element of the mandrel 201 to prevent axial displacement of the sleeve 103 and the second left-threaded collar 1405 may act as a threaded element threadedly attached to the mandrel 201 to apply axial compression to the sleeve 103.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component, comprising;

a segmented sleeve slideably attached over the exterior of a mandrel which is adapted for connection to an adjacent tool string component;

an end of the sleeve is abutted against a shoulder element of the mandrel and an opposite end of the sleeve is axially loaded by a threaded element threadedly attached to the mandrel;

the sleeve comprises at least one sleeve segment with an engagement end comprising at least one axial anti-rotation assembly adapted to transfer torque to an adjacent sleeve segment, the shoulder element, or the threaded element.

2. The tool string of claim 1, wherein the sleeve is in communication with a power source.

3. The tool string of claim 1, wherein the sleeve comprises electronic components within blades extending from the sleeve.

4. The tool string of claim 3, wherein the electronic components comprise a Lacoste gravimeter, an absolute gravimeter, a superconducting gravimeter, gyros, computer chips, memory, electronic filters, AD/DA converters, power sources, buffers, sensors, drilling instrumentation, processors, or a combination thereof.

5. The tool string of claim 1, wherein the sleeve comprises pins disposed on the inner diameter of the sleeve adapted to attach to the outer surface of the mandrel.

6. The tool string of claim 1, wherein the sleeve comprises a cylindrical seal extending from the bore of one segment of the sleeve to the bore of another segment of the sleeve.

7. The tool string of claim 6, wherein the seal is an o-ring disposed on the interior of the sleeve.

8. The tool string of claim 1, wherein the anti-rotation assembly comprises a stress release groove on spaces intermediate teeth.

9. The tool string of claim 1, wherein the mandrel comprises windows disposed on the exterior of the mandrel that engages pins.

10. The tool string of claim 1, wherein the mandrel is a drill pipe axially disposed within the sleeve.

11. The tool string of claim 1, wherein the anti-rotation device comprises teeth extending from one segment to another adjacent segment.

12. The tool string of claim 11, wherein the teeth are adapted to withstand 20,000 ft/lbs of torque.

13. The tool string of claim 11, wherein the teeth comprise a wave geometry.

14. The tool string of claim 11, wherein the teeth comprise a thickness equal to the thickness of the sleeve wall.

15. The tool string of claim 11, wherein the teeth comprise a jagged geometry with the peak of each tooth offset to one side.

16. The tool string of claim 11, wherein the teeth are formed on the outer surface of the sleeve extending toward an adjacent segment.

17. The tool string of claim 1, wherein the anti-rotation assembly comprises spaces intermediate teeth adapted to receive teeth from the opposing segment.

18. The tool string of claim 17, wherein the spaces intermediate the teeth comprise a width equal to the width of the teeth.

19. The tool string of claim 18, wherein the spaces comprise a depth equal to the height of the teeth.

20. The tool string of claim 1, wherein the shoulder element is threaded onto the mandrel.

* * * * *